US010840015B2

(12) United States Patent
Lubas

(10) Patent No.: US 10,840,015 B2
(45) Date of Patent: Nov. 17, 2020

(54) LAMINATED CORE ROTATABLE TRANSFORMER

(71) Applicant: Hitachi, Ltd., Tokyo (JP)

(72) Inventor: Michael J. Lubas, Hillsdale, NJ (US)

(73) Assignee: HITACHI INDUSTRIAL PRODUCTS, LTD., Tokyo (JP)

( * ) Notice: Subject to any disclaimer, the term of this patent is extended or adjusted under 35 U.S.C. 154(b) by 611 days.

(21) Appl. No.: 15/659,668

(22) Filed: Jul. 26, 2017

(65) Prior Publication Data

US 2019/0035548 A1 Jan. 31, 2019

(51) Int. Cl.

| | |
|---|---|
| ***H01F 21/06*** | (2006.01) |
| ***H01F 38/18*** | (2006.01) |
| ***H01F 30/06*** | (2006.01) |
| ***H01F 27/24*** | (2006.01) |

(52) U.S. Cl.

CPC ..... *H01F 38/18* (2013.01); *H01F 27/24* (2013.01); *H01F 30/06* (2013.01)

(58) Field of Classification Search

USPC ..... 336/120

See application file for complete search history.

(56) References Cited

U.S. PATENT DOCUMENTS

| | | | | |
|---|---|---|---|---|
| 6,204,587 | B1 * | 3/2001 | Torok | H02K 1/246 310/168 |
| 2014/0340185 | A1 * | 11/2014 | Verleur | H01F 27/245 336/120 |
| 2020/0195096 | A1 * | 6/2020 | Loesch | H02K 1/12 |

OTHER PUBLICATIONS

English translation of JP362067805A (Year: 1987).*

* cited by examiner

*Primary Examiner* — Ronald Hinson

(74) *Attorney, Agent, or Firm* — Mattingly & Malur, PC

(57) ABSTRACT

In some examples, a rotatable transformer includes a first core half mounted on a rotor and a second core half mounted on a stator. Each core half may include a first element having a ring shape and constructed of a laminated sheet material layered in a radial direction from an axis of rotation of the rotor, and a second element having a ring shape and constructed of a laminated sheet material layered in a direction of the axis of rotation. The second element may be positioned adjacent to the first element and at angle thereto, and a coil winding may be located in an area of the angle formed by the first element and the second element. The first core half and the second core half may be positioned adjacent to each other with a gap there between. The gap may be conical about the axis of rotation.

19 Claims, 9 Drawing Sheets

LAMINATED CORE ROTATABLE TRANSFORMER

BACKGROUND

Several common types of generators include doubly-fed induction generators and permanent magnet generators. Both of these types of generators have efficiency and power-density advantages over other types of electromechanical machines. Further, a doubly-fed induction generator has an advantage over a permanent magnet generator in that the controlling power electronics only need to convert the frequency of power from either the rotor winding or (less typically) the stator winding. Furthermore, doubly-fed induction generators are generally less expensive than permanent magnet generators. However, a significant disadvantage of doubly-fed induction generators is the need to use sliprings and brushes. Sliprings and brushes reduce reliability and increase maintenance requirements, making doubly-fed induction generators less desirable for some types of applications.

Another type of device is the rotatable transformer, also referred to as a "rotating transformer". Rotatable transformers typically are not used in high power applications. For instance, conventional rotatable transformers have two common configurations, axial or radial. In an axial rotatable transformer, a first winding in a first plate faces a second winding in a second plate, separated by a gap perpendicular to an axis of rotation. On the other hand, in a radial rotatable transformer, a first winding in a first housing encircles a second winding and a shaft. The shaft and the second winding typically rotate within the first winding. A limitation with both the axial and radial configurations is that a homogeneous material such as sintered ferrite is generally used as the cores supporting the windings. The configurations of conventional rotatable transformers do not enable high power densities or high efficiency.

SUMMARY

Some implementations include arrangements and techniques for a rotatable transformer that includes a first core half mounted on a rotor and a second core half mounted on a stator. Each core half may include a first element having a ring shape and being constructed of a laminated sheet material layered in a radial direction away from an axis of rotation of the rotor. Additionally, each core half may include a second element having a ring shape and being constructed of a laminated sheet material layered in a direction of the axis of rotation. Further, the second element may be positioned adjacent to the first element and at angle thereto, and a coil winding may be located in an area of the angle formed by the first element and the second element. The first core half and the second core half may be positioned adjacent to each other with a gap there between. The gap may be conical about the axis of rotation.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Figure 1:
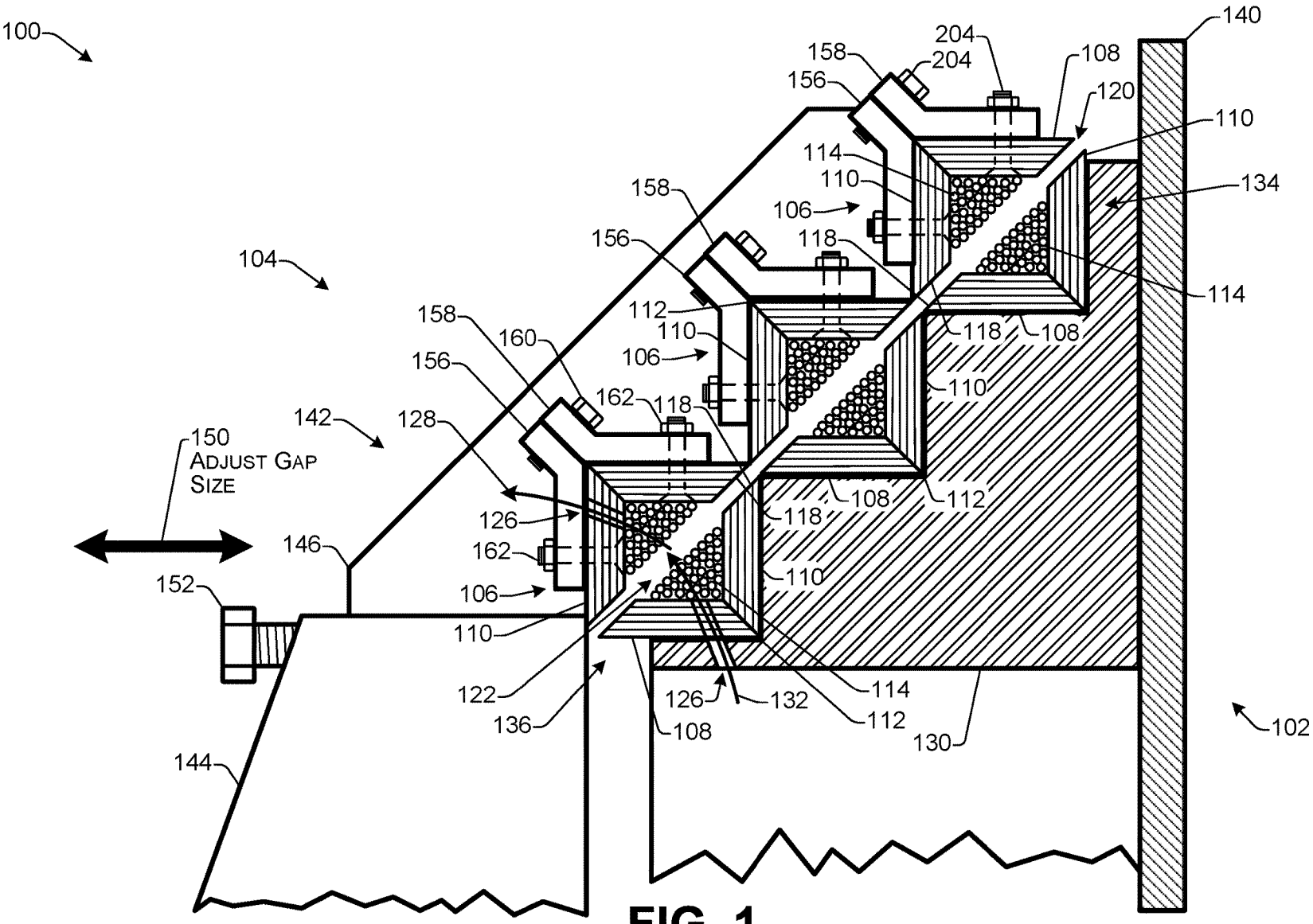
FIG. 1 illustrates a cross sectional view of a portion of an example rotatable transformer according to some implementations.

The technology herein includes novel arrangements and techniques for a rotatable transformer that can be used in an induction generator, e.g., at the non-drive end of a generator shaft, or in a motor, or for various other applications. Some implementations herein include a rotatable transformer with a toroidal coil and core able to conduct magnetic flux both radially and axially. As one example, the rotatable transformer may include two different types of laminated elements on both the stator and the rotor, such that the two types of laminated elements make up one core half, and together, the four laminated elements make up a transformer core. For example, each core half (whether on the stator or rotor) may include a first type of laminated element in which the laminated material is laminated together as an axial stack of a plurality of layers of flat plates or sheets arranged in a hollow circle or ring shape.

Further, each core half (whether on the stator or rotor) may include a second type of laminated element in which the laminated material is laminated together as a cylindrical coil of flat lamination material. As one example, the second type of laminated element may be manufactured using a single strip of the laminated material layered on top of itself, such as like a roll of tape (e.g., a laminated spiral). Thus, the second type of laminated element may also be formed generally ring shaped and may be approximately the same inner or outer diameter as the first laminated element for the same core half. The two types of laminated elements may be installed in contact with each other, e.g. at a right angle to each other, or other desired angle, to form one half of the core on the stator, and a similar pair of laminated elements may be installed together on the rotor.

When the rotatable transformer is assembled together, the separate core halves on the stator and rotor may be placed closely adjacent to each other such that a small gap between the two halves has a conical configuration, e.g., such as may be formed by adjacent 45-degree conical surfaces. For example, the generally conical adjacent surfaces within both the stator and rotor cores may enable the two core halves to be positioned very closely to each other with only a minimal gap. The gap between the transformer stator and rotor thus may also be conical in configuration from the centerline of rotation, e.g., 45 degrees or other desired angle, such as any angle between 20 and 70 degrees.

In some examples, the material used to create the laminated elements for the cores herein may be silicon steel, amorphous steel, or other material capable of providing suitable magnetic properties. Silicon steel, also referred to as electrical steel, is a steel alloy usually having a silicon content of around 3 percent to produce desirable magnetic properties, such as a small hysteresis area, which in turn results in low power loss per cycle, low core loss, and high permeability. Alloying steel with silicon significantly increases the electrical resistivity of the steel, decreasing induced eddy currents and narrowing the hysteresis loop of the material, thereby lowering the core loss. Furthermore, while silicon steel is described as one example of a suitable material, implementations herein are not limited to this material, and may include other materials as will be apparent to those of skill in the art having the benefit of the disclosure herein.

Some examples herein use laminations of sheet or ribbon material, such as silicon steel or other material having suitable magnetic properties, such as the properties discussed above, to form multi-part laminated cores for the rotatable transformers herein. In some cases, the laminated sheet material may include insulating material between laminated layers. The laminated cores herein allow the rotor windings to use higher voltages than may typically be used with sliprings/brushes or in conventional rotatable transformers, thereby reducing rotor currents and increasing operating efficiency. Further, higher voltages provide an advantage in situations in which generated power is to be transmitted over a distance because higher voltages transmit over distances more efficiently than lower voltages. For example, a conventional slipring/brush-equipped doubly-fed induction generator may require an additional transformer in the transmission path to boost the voltage produced by the conventional slipring generator. On the other hand, a generator using the rotatable transformers herein may be able to transmit power over the same distance without use of an additional transformer.

Further, eliminating sliprings and brushes may enable implementations herein to be used in new operating environments. For example, sliprings may have a sparking risk, which precludes their use in hazardous and explosive environments, but the rotatable transformers herein do not share that risk. Furthermore, sliprings and brushes may require regular maintenance, thus making remote power production, such as in the case of offshore wind turbines, impractical for generators that employ sliprings and brushes. On the other hand, some implementations herein may operate in harsh environments with minimal maintenance.

In in some examples, the laminated elements may be oriented with respect to the coil windings such that the laminated elements may be able to conduct loss-inducing current in the same direction as (e.g., parallel to), the direction of the current in the coil windings. Accordingly, to prevent circumferential current flow in the cores, both the rotor cores and the stator cores may include one or more electrical breaks in their respective electrical paths. As one example, such a break may be formed using a saw or other cutting instrument, and by cutting on a plane at a right angle to the rotor centerline (i.e., the centerline of rotation). Accordingly, the cores may be configured as a radially split toroid having a square cross-section. An electrically insulating material may be placed into the electrical break to help maintain structural integrity of the cores and other parts of the rotatable transformer having the electrical breaks formed therein, and further to ensure that the spacing of the electrical break is maintained and the two surfaces on opposite sides of the electrical break are not able to touch. Electrical breaks, insulation, and/or electrically non-conductive material may also be used for the rotor shaft and a collar or other supporting structures that support the transformer cores to also prevent the structural components from completing an electrical circuit.

In addition, some implementations herein are configured to remove heat from the coil windings to avoid overheating and enable continuous operation of the rotatable transformer herein. For example, while heat transfer may be relatively sufficient through a laminated core parallel to the laminations, heat transfer through a laminated stack of sheet material having a plurality of insulated surfaces may typically be poor. Accordingly, some examples herein include provisions for removing heat from the coil windings, rather than relying on the heat passing perpendicularly through the layers of the laminations.

As one example, air or other coolant may be placed in direct or close contact with the coil windings by at least one of: (1) including a circular coolant channel parallel to the windings, or (2) by enabling a substantial flow of coolant at the gap between the two halves of each core. One technique for producing this cooling capability while still maintaining a small magnetic gap between the rotor and stator core halves may include setting the coil windings deep into the core halves so that the clearance from rotor winding to stator winding is substantially larger than the gap between the adjacent core faces. As another example, cooling may be improved by making one of each mating core face discontinuous, such as by creating coolant channels. For example, coolant channels may be formed in at least one of the rotor or the stator core half, such as passing through a laminated element. In some examples, coolant channels may pass through each of the two sets of mating faces from the inside adjacent to the coil windings out to the ambient environment.

In addition, the performance of the rotatable transformer may be influenced by the size of the gap in the magnetic flux path. In stationary transformers this gap, e.g., typically two gaps in each flux circuit may be controlled by inserting a layer of non-ferromagnetic material to provide the desired separation. However, for the rotatable transformer herein, a tolerance buildup during assembly, or various other factors may result in excessive variability of the gap. Accordingly, implementations herein enable the distance between the adjacent interacting conical surfaces to be adjustable by providing for controlled axial displacement of at least some of the core portions. For example, during machine assembly, the stator components may be in direct contact with the rotor components. Subsequently, when putting the rotatable transformer into service, one or more adjustment screws or other adjustment mechanisms may be used to withdraw the stator face from the rotor face, or vice versa, until the gap is at a specified or otherwise desired dimension.

For discussion purposes, some example implementations are described in the environment of a rotatable transformer that may be used for a generator or the like. However, implementations herein are not limited to the particular examples provided, and may be extended to other service environments, use of the rotatable transformer in a motor, or for other applications, as will be apparent to those of skill in the art in light of the disclosure herein. For example, implementations herein may be used in motors or generators, may be used in single phase or polyphase machines, and are suitable for use in non-synchronous induction machines or synchronous machines.

As several non-limiting examples, the rotatable transformer herein may be used in doubly-fed induction generators for off-shore or land-based wind turbines. For instance in the case of off-shore wind turbines, the rotatable transformer herein may provide increased reliability as compared with sliprings/brushes, and may eliminate many service access events, which is an important consideration for off-shore turbines because access by boat or helicopter may be expensive and risky. Furthermore, as mentioned above, higher voltage rotor windings may be used, and higher speed of operation is possible without brush or slipring limitations. In addition, advantages compared to permanent magnet generator are also substantial, including cost and simple power conversion. Land-based applications may provide similar benefits.

In addition, implementations herein may be used as doubly-fed motors. Such a machine is not commonly used, but these types of doubly-fed motors may be useful in applications that require a variable frequency drive and an induction motor. For example, with a doubly-fed system, it may be possible for the variable frequency drive to control rotor (or stator) power only, which may improve overall system cost and efficiency. Examples of such applications may include industrial pumps and compressors; upstream oil and gas industry applications; traction motors in electric and hybrid-electric vehicles (possibly even displacing permanent magnet motors in automotive applications); and high-speed motors, such as machine tool spindles. In addition, the rotatable transformers herein may be useful in other types of applications, such as computer tomography (CT) scanners, or the like.

FIG. 1 illustrates a cross-sectional view of an example portion of a rotatable transformer 100 according to some implementations herein. The rotatable transformer 100 includes a stator 102 and a rotor 104. The rotor 104 is able to rotate relative to the stator 102 about a central axis of rotation horizontal to the view of FIG. 1, such as on a shaft or the like (not shown in FIG. 1). The rotatable transformer 100 in this example includes three transformer cores 106 and thus is able to serve as a three-phase transformer. However, in other examples, the rotatable transformer 100 may include a single core, two cores, or more than three cores.

Each core 106 may include a first core half on the stator side and a second core half on the rotor side. Furthermore, each core half may include a radially stacked, coiled, or otherwise radially layered laminated element 108 constructed with a plurality of layers of sheet material. Additionally, each core half may include an axially stacked or otherwise axially layered laminated element 110 constructed with a plurality of layers of sheet material. Each of the laminated elements 108 and 110 may be generally ring-shaped and may be placed at a right angle in relation to another laminated element of the other type by being placed in contact with each other on one adjoining edge 112. Furthermore, while the right angle is evenly divided into 45 degree angles at the adjoining edge 112 of elements 108 and 110 in this example, in other examples, other complementary angles may be used for the adjoining edge 112.

For each core half, a coil winding 114 may be included in the space created by the interior angle of the two adjoining laminated elements 108 and 110. The coil winding 114 may be wound copper wire or a winding of any other suitable conductor. In some examples, the coil winding may be essentially flush with faces 118 of the laminated elements that face 118 of the other laminated elements 108 and 110 in the other core half. In other examples, however, as discussed additionally below with respect to FIG. 6, the coil winding may be recessed substantially into the interior of the angle to provide an additional cooling effect for the rotatable transformer 100.

In this example, there is a single conical gap 120 between the adjacent faces 118 of the laminated elements 108 and 110 of the rotor 104 and the stator 102. As indicated at 122, the gap 120 may be larger between the coil windings 114 than between the adjacent faces 118 of the laminated elements of the rotor 104 and the stator 102. Accordingly, the configuration illustrated may provide some cooling advantages over having the coils 114 flush with or extending beyond the adjacent faces 118 of the laminated elements 108 and 110.

In this example, the three single phase transformers corresponding to the three cores 106, respectively, are of sequentially different diameters in the radial direction from the axis of rotation, and are arranged side-by-side to share the common gap 120. Further, because the faces 118 of the laminated elements are set at 45 degrees, the gap 120 forms a 90 degree cone centered at the axis of rotation of the rotor 104, which corresponds to the centerline of the shaft (not shown in FIG. 1). Furthermore, while this example shows the rotor 104 having larger diameter cores halves than the stator 102, which may provide better resistance to stresses produced by rotation, in other examples, the positions of the rotor and stator may be reversed and the smaller diameter cores may be made rotatable.

In some examples, the gap 120 may be uniform from the smaller diameter core to the larger diameter core. In other examples, the gap 120 may be nonuniform, e.g., the gap at each transformer core 106 may be different from that at others of the transformer cores 106 (e.g., at the larger and smaller diameter locations), and the gap 120 does not need to be coplanar or equal-angled. Furthermore, the angle of the gap may be selected be chosen based upon the relative width of the horizontal and vertical core thicknesses. For instance, in this example, the radially layered laminated elements 108 have a width that is equal to the height of the axially layered laminated elements 110, thereby providing the 45 degree angle. In other examples, however, if the radially layered laminated elements 108 are made to have a width that is larger or smaller than a height of the axially layered laminated elements 110, then the angle of the gap 120 may be different based on the difference between width and height. Additional variations are discussed below, e.g., with respect to FIG. 6.

As mentioned above, coolant channels 126 may be formed in at least one of the rotor core half or the stator core half, such as passing through a laminated element 108 or 110. In the illustrated example, a first cooling channel 126 is formed through the axially layered laminated element 110 to enable air to flow through the coil 114 and out of the cooling channel 126, as indicated by arrow 128. In addition, a second cooling channel 126 may be formed through the material of a stator support 130 and through a radially layered laminated element 108 to enable cooling air to flow into the gap 120, as indicated by arrow 132, across the coil windings 114 and out through the rotor half of the core 106. Furthermore, while two cooling channels 126 are illustrated herein, numerous other cooling channels 126 may be formed in a similar manner in any of the cores 106, but are not illustrated in this figure for the sake of clarity.

Additionally, in some examples, where the coolant is the ambient air or other gas, the rotating core face at the larger diameter mating surface pair 134 may be discontinuous to maximize the airflow based on a centrifugal fan effect caused by the gap opening on the upper (outside) end of the gap 120. The stationary core face at the smaller diameter mating surface pair 136 may also be discontinuous to minimize the airflow restriction of the opening at the lower (inside end) of the gap 120. An example of a discontinuous face is discussed and illustrated additionally below with respect to FIG. 8.

Alternatively, in some examples, the coolant may be oil or other liquid, and the rotating core face at the smaller diameter mating surface at 136 may be discontinuous to produce a pumping action and for inducing a swirl effect adjacent to the coil windings 114 to enhance convective heat transfer. The rotating core face at the larger diameter mating surface pair at 134 may be continuous to prevent excess circulation, and to prevent drawing too much fluid from inside the gap 120, and thereby to avoid air pockets or cavitation.

In this example, the stator half of each of the cores 106 is mounted on the stator support 130, as discussed additionally below with respect to FIGS. 2 and 3. The stator support 130 may be a stationary support that is mounted on a housing or other fixed structure 140. In this example, the rotor 104 includes a radial support 142 that includes a fixed radial support 144 that is connected to a collar on the shaft (not shown in FIG. 1). The radial support 142 further includes a movable support member 146 that is movable in an axial direction, e.g., parallel to the axis of rotation, to enable the size of the gap 120 to be adjusted, as indicated by arrow 150. As one example of an adjustment mechanism, a screw 152 may be turned to move the movable support member 146 toward or away from the stator 102. In some examples, the stator 102 and the rotor 104 may be assembled together with the adjacent faces 118 of the core halves in contact with each other. When it is time to place the rotatable transformer into service, a worker may adjust the screw 152 to adjust the size of the gap 120 to a specified or desired gap size.

Each of the rotor core halves may be supported by one or more brackets, which may be welded, fastened, or otherwise attached to the radial supports 142. For example, a first bracket 156 may support the axially layered laminated elements 110, and a second bracket 158 may be connected to the first bracket by a fastener 160 or other suitable means, and may support the radially layered elements 108. Furthermore, in this example, fasteners 162 are used to connect the core elements 108 and 110 to the brackets 158 and 156, respectively. However, in other examples, adhesive or other suitable techniques may be used for mounting the laminated elements 108 and 110 to the rotor 104 and/or the stator 102. Numerous other possible configurations for mounting the transformer cores 106 to a rotor and stator to enable relative rotation between the two core halves will be apparent to those of skill in the art having the benefit of the disclosure herein.

Figure 2:
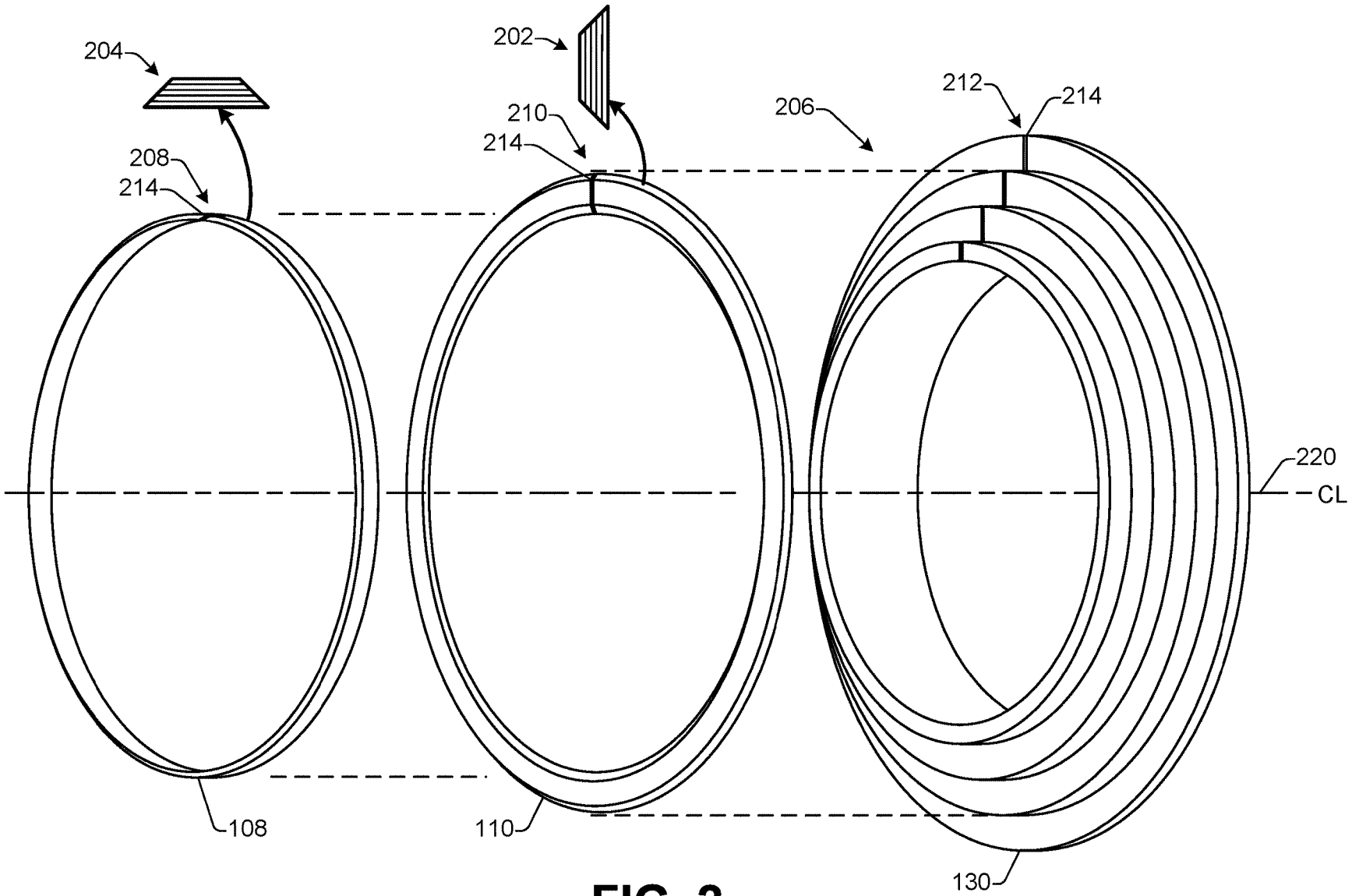
FIG. 2 illustrates a perspective view of example first and second laminated elements for mounting on a stator support according to some implementations.

FIG. 2 illustrates an example expanded perspective view of the stator support 130, one of the axially layered laminated elements 110 and one of the radially layered laminated elements 108 according to some implementations. This example shows that the axially layered laminated element 110 has a generally vertically disposed trapezoidal cross-section, as indicated at 202, which may be formed using any of various manufacturing techniques. Furthermore, the radially layered laminated element 108 has a generally horizontally disposed trapezoidal cross section as indicated at 204. As mentioned above, in some examples, the radially layered laminated element 108 may be formed by winding a ribbon or sheet of lamination material around a suitably sized cylinder to form a coil of the lamination material, similar to a roll of tape, or the like.

The stator support 130 includes a plurality of steps 206, such as one step to accommodate each pair of laminated elements 108 and 110. As mentioned above, the laminated elements 108 and 110 may be attached to the stator support 130 using any suitable fastening techniques such as mechanical fasteners, adhesives, or the like.

In addition, before or after assembly to the stator support, an electrical break may be formed in each of the laminated elements 108 and 110, as well as in the stator support 130 if the stator support 130 is made of a conductive material, to prevent these components from conducting loss-inducing current in the same direction as (e.g., parallel to) the direction of the current in the coil windings. Accordingly, in this example, the radially layered laminated element 108 includes an electrical break 208, the axially layered laminated element 110 includes an electrical break 210, and the stator support 130 includes an electrical break 212. The electrical breaks 208, 210, and 212 may be aligned during assembly so that current and magnetic flux cannot jump around the breaks 208, 210, and 212. Alternatively, as mentioned above, the electrical breaks 208, 210, and 212 may be formed after assembly, such as by using a cutting instrument, to ensure the alignment of the electrical breaks 208, 210, and 212. In addition, an insulation material 214 may be inserted into the respective electrical breaks to assist in maintaining the space formed by the electrical breaks 208, 210, and 212, and to maintain the structural integrity of the respective laminated elements 108 and 110, and the stator support 130. Examples of insulation material 214 include non-conductive resins or other non-conductive polymers.

Some implementations herein allow magnetic flux to be higher and core loss lower because of the superior properties of magnetic cores made from laminated layers of thin, insulated material such as silicon steel sheets that are oriented to maximize magnetic permeability and minimize circulating currents. As mentioned above, the laminated elements 108 and 110 may be constructed of silicon steel or a ferromagnetic sheet material other than silicon sheet steel, including, for example, amorphous metal ribbon, such as amorphous steel. The use of an amorphous metal may allow lower core losses when operating loads are low.

Additionally, in some examples, the laminated elements 108 and 110 may be made using a hybrid construction, such as by using more than one ferromagnetic material for cost or performance advantages. As one example, the radially layered laminated element 108 may be constructed using amorphous metal ribbon, while the axially layered laminated elements 110 may be constructed using silicon steel laminations.

Accordingly, some examples herein orient flat, uniform thickness lamination material such that a flux path can develop around the coil winding. This would be difficult to accomplish with rotor and stator coils whose conductors run concentric to the rotor shaft in round toroidal-like coils using laminations to continuously surround the coils. For instance, to provide a solid core, the thickness of the laminations would need to vary across the lamination in proportion to the distance to the axis of rotation of the transformer. That is, the lamination would be thin at a small radial distance from a rotor centerline 220 and proportionately thicker at a greater radial distance. Accordingly, implementations herein avoid this problem.

Figure 3:
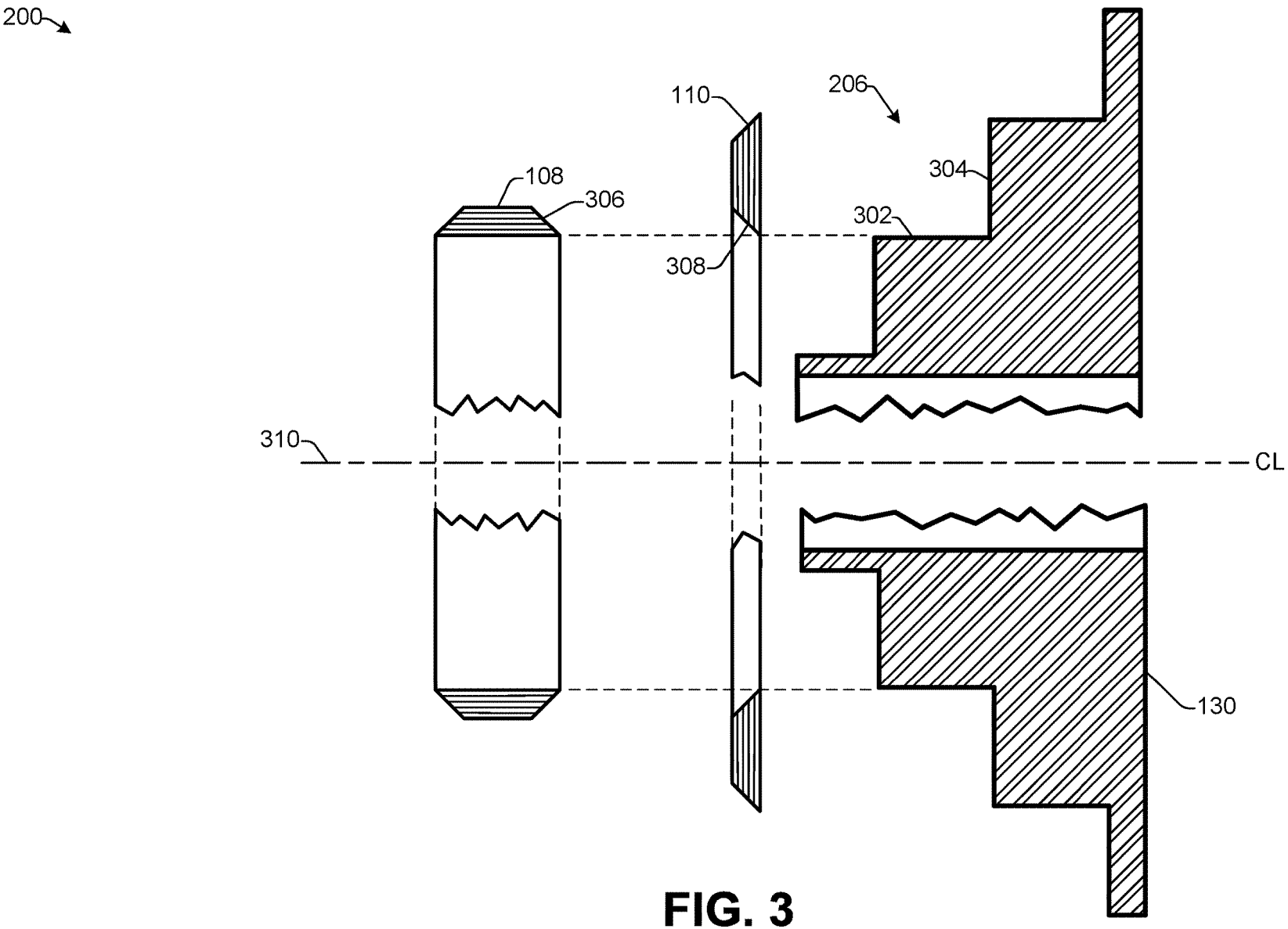
FIG. 3 illustrates a cross-sectional view of the example first and second elements of FIG. 2 according to some implementations.

FIG. 3 illustrates a cross-sectional view of the elements of FIG. 2 according to some implementations. In this example, the axially layered laminated element 110 is placed onto the stator support 130 until the laminated element 110 contacts with a back wall 304 of step 302. As mentioned above, the laminated element 110 may be adhered to the back wall 304 with adhesive, mechanical fasteners, or other suitable fasteners. Subsequently, the radially layered laminated element 108 is placed onto the step 302, such that a tapered edge 306 of the radially layered laminated element 108 contacts with a tapered edge 308 of the axially layered laminated element 110. In some examples, there may be bare metal contact between the two laminated elements 108 and 110, such as by removing any insulation there between. In other examples, the insulation may remain between the two edges 306 and 308 of the laminated elements 108 and 110, respectively. In addition, this figure illustrates a centerline 310, which corresponds to the centerline of the shaft (not shown in FIG. 3), and the axis of rotation for the rotor, as discussed above with respect to FIG. 1.

Figure 4:
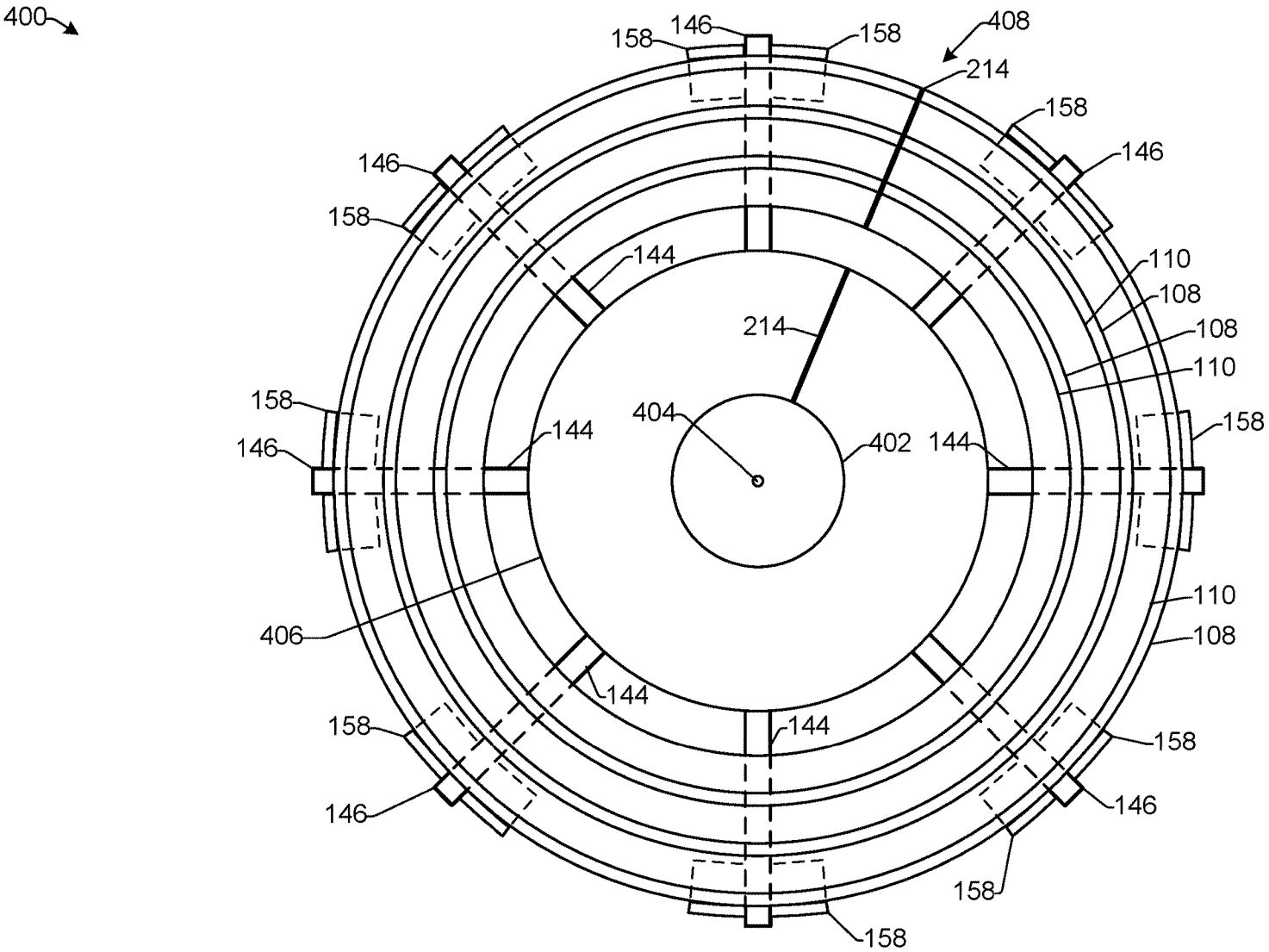
FIG. 4 illustrates an example plan view of a rotor assembly corresponding to FIG. 1 according to some implementations.

FIG. 4 illustrates a plan view of an example rotor assembly 400, which may serve as the rotor 104 according to some implementations herein. In this example, the coil windings are removed for clarity of description. FIG. 4 illustrates the radially layered elements 108 and the axially layered elements 110 arranged in a concentric configuration and supported by the radial supports 146, 144. FIG. 4 further shows the brackets 158 for attaching the outer laminated elements 108 to the radial supports 146. The additional brackets 158 and 156 for attaching the inner laminated elements 108 and 110 are omitted for clarity of illustration.

In addition, FIG. 4 illustrates a shaft 402 having a centerline axis of rotation 404, which may correspond to the centerline 310 discussed with reference to FIG. 3 and the axis of rotation of the rotor discussed above with respect to FIGS. 1 and 2. In this example, a collar 406 is mounted on the shaft 402, and the radial supports 144 are attached to this collar 406 and extend radially outward therefrom.

In addition, FIG. 4 illustrates an electrical break 408 that may extend from the outermost laminated element 108 through all of the laminated elements 108 and 110 in the rotor assembly 400, and which also may extend through the collar 406. Additionally, in some examples, the electrical break 408 may also extend into the shaft 402. In other examples, the shaft 402 and or the collar 406 may be insulated or constructed of a nonconductive material such as such as fiberglass or the like. In addition, an insulation material 214, such as non-conductive resin or other non-conductive polymer, may be inserted into the electrical break 408 to maintain the electrical break 408 and to add structural integrity to the parts having the electrical break 408 formed therein.

Figure 5:
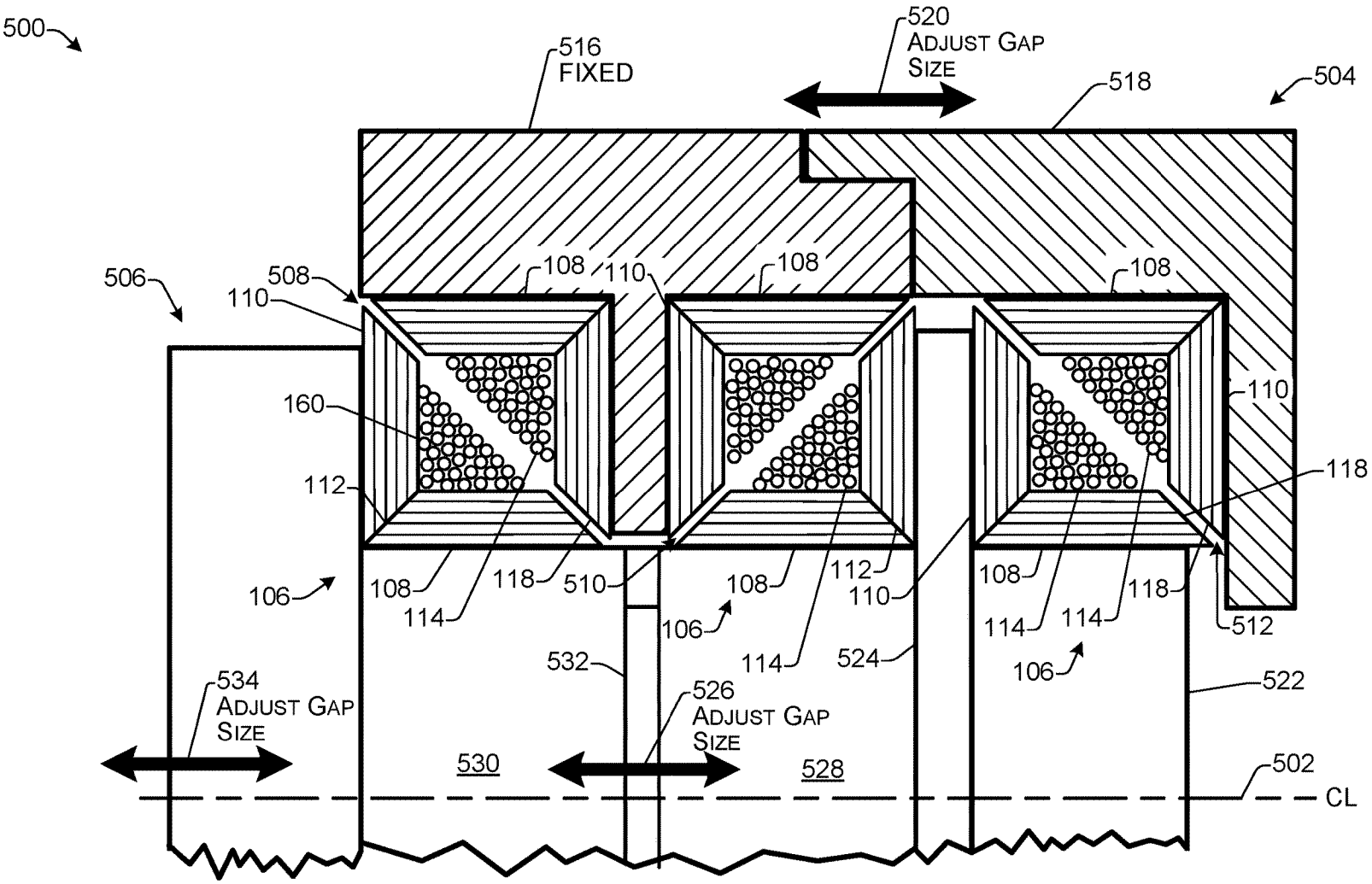
FIG. 5 illustrates a cross-sectional view of an example rotatable transformer according to some implementations.

FIG. 5 illustrates a cross-sectional view of an example a three phase transformer 500 having three identical single phase transformers in a row around a centerline axis of rotation 502 according to some implementations herein. In this example, three cores 106 corresponding to the three transformers are arranged such that each core 106 includes a first half on the stator side and a second half on the rotor side. Furthermore, each core half includes a radially layered laminated element 108 and an axially layered laminated element 110. Each of the laminated elements 108 and 110 may be generally ring-shaped and may be placed at a right angle in relation to the other laminated element, such as by being placed in contact with each other on one adjoining edge 112. Furthermore, while the adjoining edge 112 is at a 45 degree angle to the shaft centerline 502 in this example, in other examples, other angles may be used with the rotatable transformers herein.

In this example, each of the cores includes its own adjustable gap 508, 510, and 512, respectively, between the rotor 506 and the stator 504. The gaps 508, 510, and 512 between the rotor 506 and stator 504 of each phase of the rotatable transformer form a cone, with a typically 90 degree interior angle centered around the centerline axis of rotation 502. Further, while the generally conical gap is illustrated as a 90 degree angle in some examples herein, in other examples, other angles for the cone may be used, i.e., the angles of the faces 118 between the stator core halves and the rotor core halves are not limited to 45 degrees.

In this example, a first portion 516 of the stator 504 may be fixed, such as to a housing, or the like, as discussed above with respect to FIG. 1. A second portion 518 of the stator 504 may be adjustable axially, as indicated at 520, for adjusting a size of the gap 512, using a screw or other adjustment mechanism, as discussed above with respect to FIG. 1. Furthermore, a shaft 522 of the rotor 506 may include a flange 524 that supports the axially layered laminated elements 110 of the right and center cores 106. As indicated by arrow 526, a first portion 528 of the shaft may be movable toward and away from a second portion the shaft 530, such as by being slideable over an inner shaft portion 532. The first portion 528 may be held in a desired location relative to the second shaft portion 530 using a screw or other fastener or adjustment mechanism (not shown in FIG. 5), as discussed above with respect to FIG. 1, to adjust the gap 510. In addition, the shaft 522 itself may be movable axially toward and away from the fixed portion 516 of the stator 516, as indicated by arrow 534, for adjusting a size of the gap 508. Furthermore, while two example configurations of rotatable transformers have been described and illustrated herein, numerous other variations will be apparent to those of skill in the art having the benefit of the disclosure herein.

Figure 6:
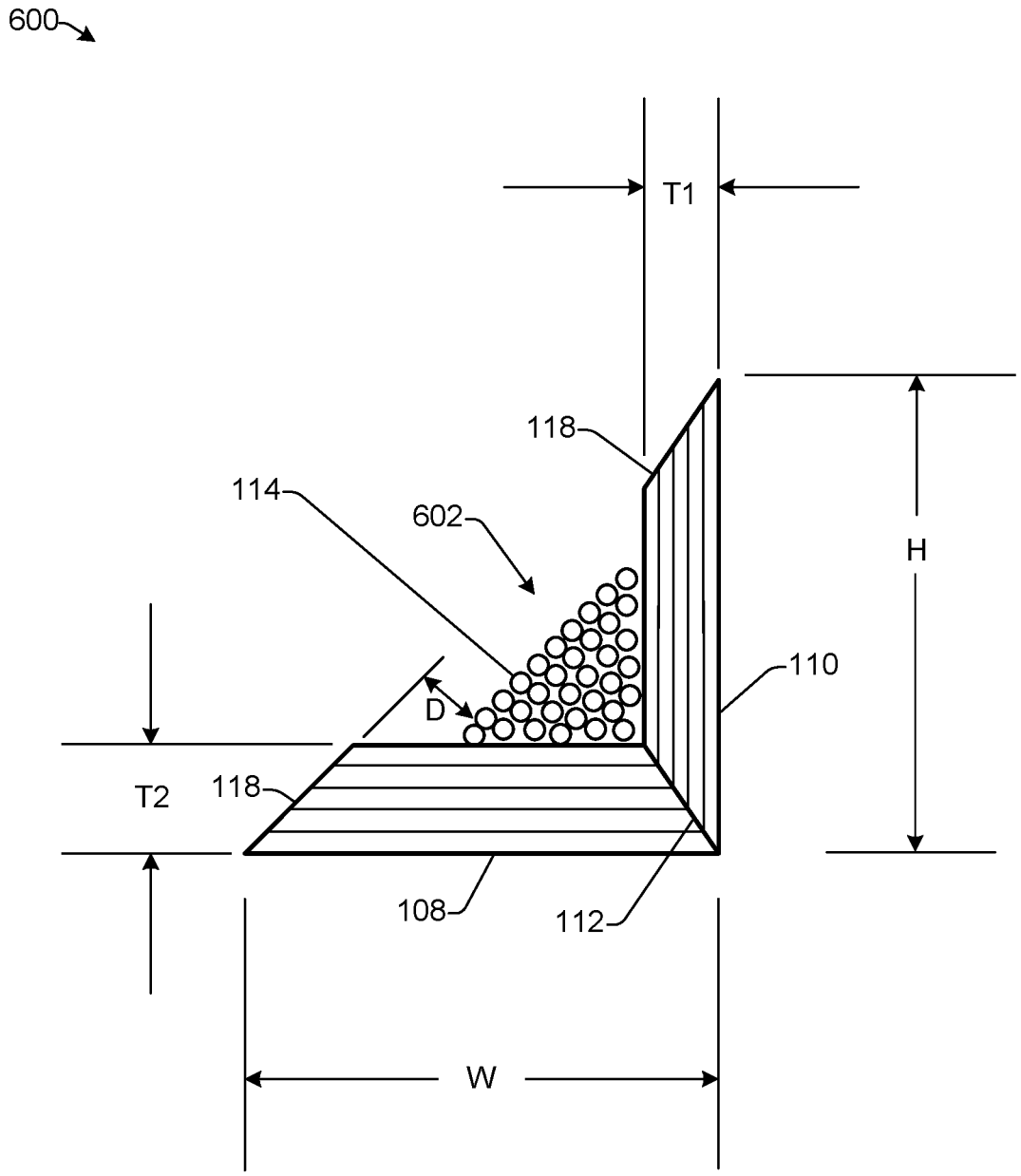
FIG. 6 illustrates a cross-sectional view of an example core half according to some implementations.

FIG. 6 illustrates a cross-sectional view of an example core half 600 according to some implementations. In this example, the core half 600 may be mated with a mirror image core half on an opposing one of a rotor or stator (not shown in FIG. 6). In this example, a thickness of one of the laminated elements is different from a thickness of the other one of the laminated elements forming the core half 600. As illustrated, the radially layered laminated element 108 has a greater thickness T2 than a thickness T1 of the axially layered laminated element 110. This configuration may allow a reduction in flux density in each laminated element to a desired lower-loss level. Accordingly, in this configuration, the angle at which the laminated elements 108 and 110 are joined at 112 may be an angle other than 45 degrees. Furthermore, as mentioned above, in some examples, a height H of the axially layered laminated element 110 may be different from a width W of the radially layered laminated element 108. Furthermore, in this example, the coil winding 114 is located completely within the interior angle 602 of the joined laminated elements 108 and 110, and is located at a distance D from the faces 118. Accordingly, this configuration may help improve the cooling efficiency of the rotatable transformer.

Figure 7:
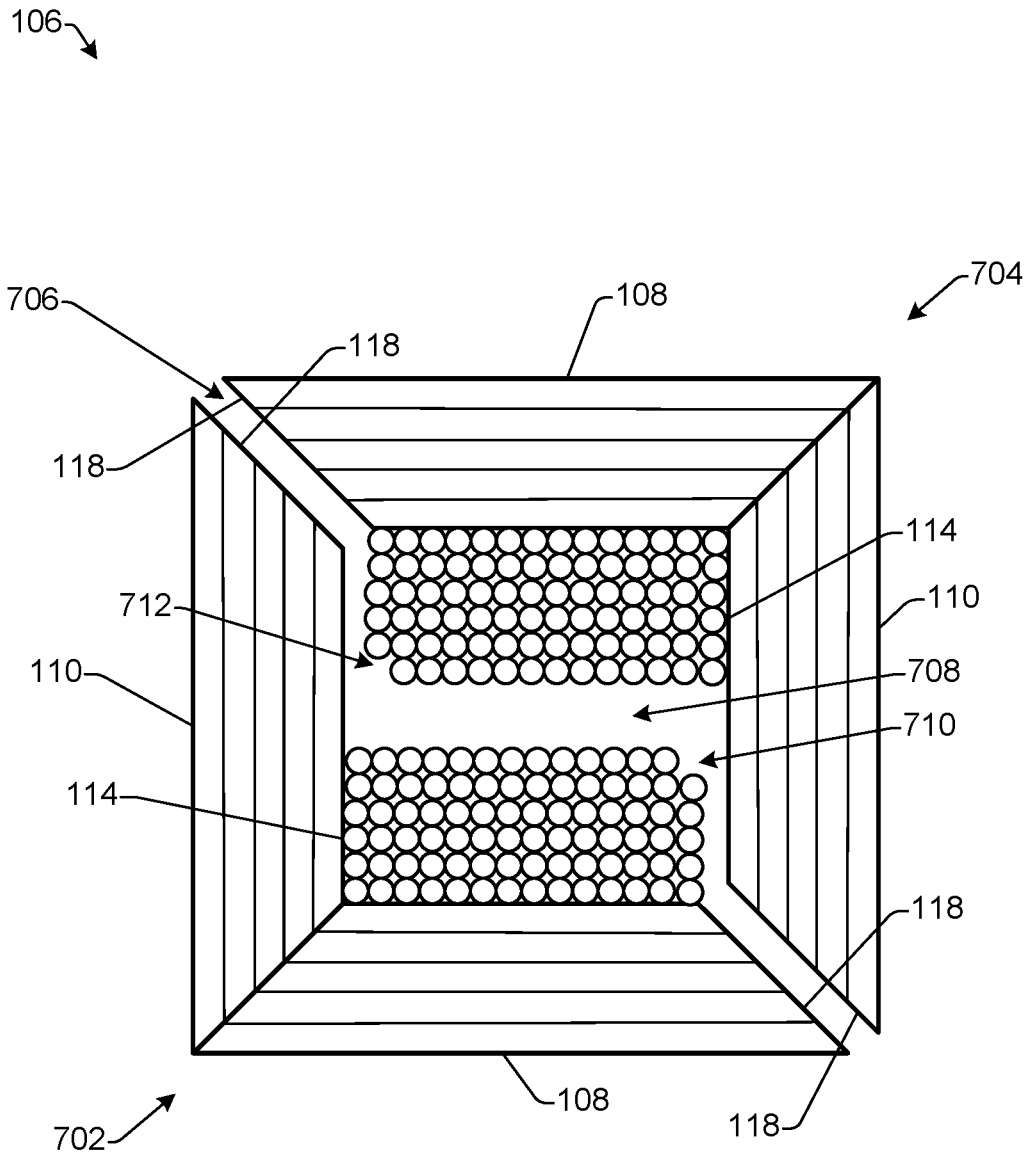
FIG. 7 illustrates a cross-sectional view of an example core according to some implementations.

FIG. 7 illustrates a cross-sectional view of a core 106 according to some implementations. In this example, a first core half 702 is positioned adjacent to a second core half 704. For example, one of the core halves may be mounted on a stator, and the other core half may be mounted on a rotor (not shown in FIG. 7). In this example, there is a conical gap 706 between the two core halves 702 and 704, which forms a cone around the axis of rotation (not shown in FIG. 7) as discussed above. However, in this example, the gap 706 is broken by the coils 114 extending into the gap 706, as indicated at 708. Further, in this example, the coils 114 actually extend beyond the mating faces 118 of the opposite core half 702 or 704, respectively, as indicated at 710 and 712.

For example, the rotor and stator coil windings 114 may have shapes other than those shown above, that do not match with any limits set by the angular gaps as long as a combined cross-sectional area of the rotor and stator coil winding is contained within the annulus area between the rotor and stator cores, i.e., the area bounded by the four laminated elements 108, 110, 108, 110, and as long as the rotor and stator remain axially separable without coil winding conflict. It is desirable for the wound stator and the wound rotor to be able to be assembled into close working proximity by axial movement only. In this example, the cross-section of the coil windings 114 is generally rectangular, but in other examples, the cross-section may be L-shaped, triangular, or other shape.

Figure 8:
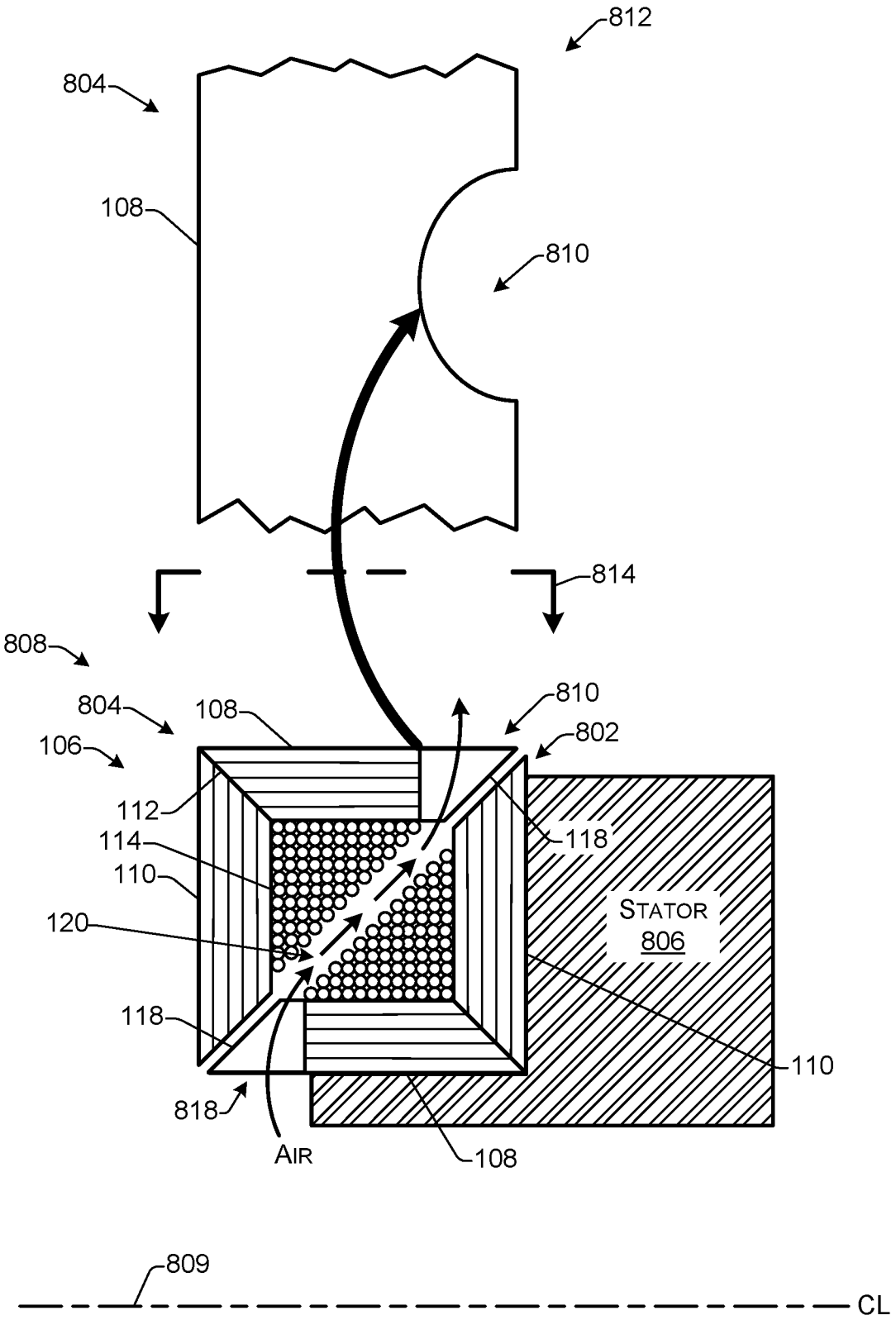
FIG. 8 illustrates an example of a core having discontinuous faces according to some implementations.

FIG. 8 illustrates an example cross-sectional view of a core 106 having discontinuous faces according to some implementations. In some cases, the core 106 may correspond to the core 134 of FIG. 1 having the largest diameter; however, in other cases, any of the cores in any of the examples herein may include a discontinuous face on one or both core halves.

In this example, the core 106 includes a stator core half 802 and a rotor core half 804. For instance, the stator core half 802 may be fixed to a stator 806, and the rotor core half 804 may be rotatable as part of a rotor 808 relative to the stator core half 802 about a centerline 809 (distance to the centerline 809 is not shown to scale). The rotor core half 804 includes a face 118 that is discontinuous having one or more openings 810 formed therein. As illustrated in a broken-away plan view 812, as viewed along the direction of line 814, the opening 810 may include any desired shape, such as elliptical, oval, rectangular, semi-circular, etc.

In addition, the stator half 802 of the core 106 may also include one or more openings 818 formed in one of the faces 118. The one or more openings 818 may have a shape similar to that of the one or more openings 810, or may be different therefrom. As illustrated, when the rotor 808 is rotating relative to the stator 806, air or other coolant may flow in through the opening 818, through the gap 120, and out through the opening 810 based on a centrifugal fan effect caused by the openings 810, 818.

Further, as discussed above with respect to FIG. 1, in some cases, the opening(s) 818 may be formed on the stator half of a smallest diameter core, and the opening(s) 810 may be formed on the rotor half of a largest diameter core. Numerous other variations will be apparent to those of skill in the art having the benefit of the disclosure herein.

Figure 9A:
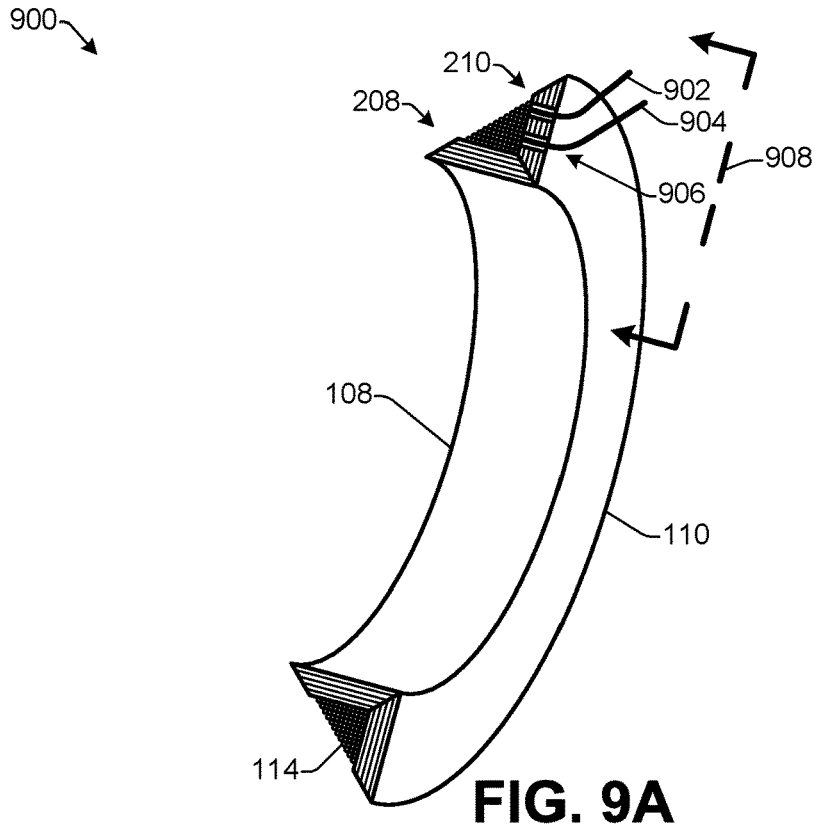
FIGS. 9A-9D illustrate examples of lead wire placement in the electrical break according to some implementations.

FIGS. 9A-9D illustrate examples of lead wire placement in the electrical break according to some implementations. FIG. 9A illustrates a cross-sectional, reverse-side, isometric view of the elements 108 and 110 of FIG. 2, assembled together and including the core winding 114. The cross-section of FIG. 9A may correspond to the electrical breaks 208 and 210 illustrated in FIG. 2 at the upper portion of the elements 108 and 110, respectively. In this example, a pair of wire electrical leads, namely a first wire lead 902 and a second wire lead 904, are inserted into the electrical break 210, such as into a pair of grooves 906 formed in at least one side of the element 110 at the electrical break 210. The wire leads 902 and 904 may be grounded, or the like, and may serve to improve the effectiveness of the electrical breaks 208 and 210 by minimizing eddy current losses at entrance and exit locations.

In addition, in some examples, there may be multiple electrical breaks in a core half, and each electrical break may include one or more electrical leads inserted into it. Additionally, or alternatively, one or more of the electrical leads may be inserted in the electrical break 208 in the element 108. Furthermore, as discussed above e.g., with respect to FIG. 4, the rotor half of each core may also include an electrical break, and one or more electrical leads may be inserted into these electrical breaks and/or the other electrical breaks discussed herein.

Figure 9B:
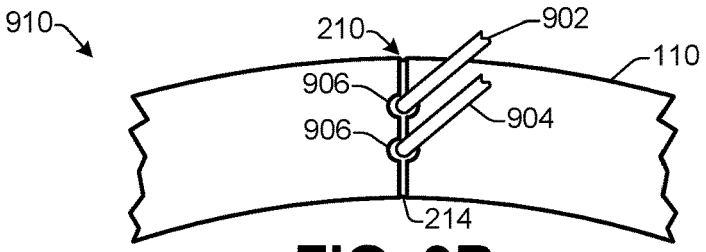

FIG. 9B illustrates an example broken view 910 taken along the direction of line 908 of FIG. 9A, with the element 110 no longer in cross section according to some implementations. In this example, the grooves 906 are shown as being formed into the element 110 on both sides of the electrical break 210. As discussed above, insulating material 214 may be placed in the electrical break 210 and in the grooves 906 to maintain structural integrity and to hold the electrical leads 902 and 904 in place in the grooves 906.

Figure 9C:
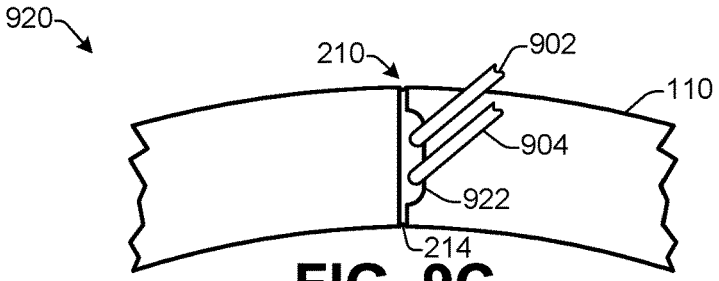

FIG. 9C illustrates an example broken view 920 taken along the direction of line 908 of FIG. 9A, with the element 110 no longer in cross section according to some implementations. In this example, the rather than a pair of grooves 906, a single groove 922 is formed into the element 110 on one or both sides of the electrical break 210. As discussed above, insulating material 214 may be placed in the electrical break 210 and in the groove 922 to maintain structural integrity and to hold the electrical leads 902 and 904 in place in the groove 922.

Figure 9D:
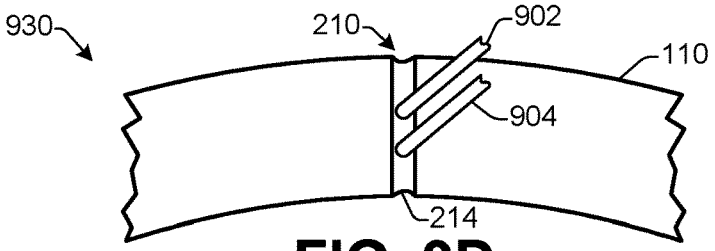

FIG. 9D illustrates an example broken view 930 taken along the direction of line 908 of FIG. 9A, with the element 110 no longer in cross section according to some implementations. In this example, rather than having grooves 906, the electrical break 210 is formed to be large enough so that the leads 902 and 904 fit into the electrical break 210 without the use of grooves in the element 110. As discussed above, insulating material 214 may be placed in the electrical break 210 to maintain structural integrity and to hold the electrical leads 902 and 904 in place in the electrical break 210. Further, while several example configurations are illustrated herein, numerous variations will be apparent to those of skill in the art having the benefit of the disclosure herein.

Although the subject matter has been described in language specific to structural features and/or methodological acts, it is to be understood that the subject matter defined in the appended claims is not necessarily limited to the specific features or acts described. Rather, the specific features and acts are disclosed as example forms of implementing the claims.

What is claimed:

1. A rotatable transformer comprising:

a first core half mounted on a rotor, and a second core half mounted on a stator, each core half including:

a first element having a ring shape and being constructed of a laminated sheet material layered in a radial direction from an axis of rotation of the rotor;

a second element having a ring shape and being constructed of a laminated sheet material layered in a direction of the axis of rotation, wherein the second element is positioned adjacent to the first element and at angle thereto; and a coil winding located in an area of the angle formed by the first element and the second element;

wherein the first core half and the second core half are positioned adjacent to each other with a gap between the first core half and the second core half to enable relative rotation between the first core half and the second core half.

2. The rotatable transformer as recited in claim 1, further comprising at least one coolant channel formed through at least one of the first element or the second element in at least one of the core halves.

3. The rotatable transformer as recited in claim 1, wherein the gap is conical about the axis of rotation.

4. The rotatable transformer as recited in claim 3, wherein a size of the gap is adjustable by relative axial movement between the rotor and the stator along the axis of rotation.

5. The rotatable transformer as recited in claim 1, wherein:

there are three of the first core halves mounted on the rotor and three of the second core halves mounted on the stator, and each first core half is positioned adjacent to a respective one of the second core halves with a gap in between.

6. The rotatable transformer as recited in claim 5, wherein:

there is a single cone-shaped gap between the three first core halves and the three second core halves; and the gap is conical about the axis of rotation.

7. The rotatable transformer as recited in claim 5, wherein:

there is a first conical gap between a first pair of the first and second core halves, there is a second conical gap between a second pair of the first and second core halves, and there is a third conical gap between a third pair of the first and second core halves.

8. An apparatus comprising:

a first core half mounted on a rotor, the rotor being rotatable about an axis of rotation;

and a second core half mounted on a stator, wherein:

the first core half and the second core half are positioned adjacent to each other with a gap between the first core half and the second core half to enable relative rotation between the first core half and the second core half; and the gap is conical about the axis of rotation, wherein each core half comprises:

a first element having a ring shape and being constructed of a laminated sheet material layered in a radial direction from the axis of rotation of the rotor;

a second element having a ring shape and being constructed of a laminated sheet material layered in a direction of the axis of rotation, wherein the second element is positioned adjacent to the first element and at angle thereto; and a coil winding located in an area formed by the angle between the first element and the second element.

9. The apparatus as recited in claim 8, wherein a size of the gap is adjustable by relative axial movement between the rotor and the stator along the axis of rotation.

10. The apparatus as recited in claim 8, wherein the laminated sheet material is at least one of silicon steel or amorphous steel.

11. The apparatus as recited in claim 8, wherein the first element has a different thickness of laminated layers than the second element.

12. The apparatus as recited in claim 8, wherein the coil winding has a rectangular cross section extending into the gap.

13. The apparatus as recited in claim 8, further comprising an electrical break formed radially through the first core half and the second core half.

14. The apparatus as recited in claim 13, further comprising at least one electrical lead extending into the electrical break and being connected to a ground.

15. An apparatus comprising:

three first core halves supported by a first support;

three second core halves supported by a second support, wherein:

the first support is rotatable in relation to the second support about an axis of rotation;

each of the first core halves is positioned adjacent to a respective one of the second core halves to form a core having a rectangular cross-section; and each core half includes:

a first element having a ring shape and being constructed of a laminated sheet material layered in a radial direction from the axis of rotation;

a second element having a ring shape and being constructed of a laminated sheet material layered in a direction of the axis of rotation, wherein the second element is positioned adjacent to the first element and at angle thereto; and a coil winding located in an area formed by the angle between the first element and the second element.

16. The apparatus as recited in claim 15, wherein the three cores operate as a three-phase transformer.

17. The apparatus as recited in claim 15, wherein there is at least one gap between the first core halves and the second core halves, the gap forming a cone about the axis of rotation.

18. The apparatus as recited in claim 17, wherein at least one of the first support or the second support is moveable in a direction along the axis of rotation for adjusting a size of the at least one gap.

19. The apparatus as recited in claim 17, wherein there are three different gaps, each gap forming a separate cone about the axis of rotation.

* * * * *